US006074240A

United States Patent [19]

Bradshaw et al.

[11] Patent Number: 6,074,240

[45] Date of Patent: Jun. 13, 2000

[54] TERMINAL BLOCK

[75] Inventors: Janet A. Bradshaw, Flower Mound, Tex.; Robert M. Dominiak, Chicago, Ill.; Wayne G. Haines, Toccoa, Ga.

[73] Assignee: Marconi Communications Inc., Cleveland, Ohio

[21] Appl. No.: 08/948,973

[22] Filed: Oct. 10, 1997

Related U.S. Application Data

[60] Provisional application No. 60/028,859, Oct. 16, 1996.

[51] Int. Cl.[7] ..... H01R 4/24

[52] U.S. Cl. ..... 439/412; 439/709

[58] Field of Search ..... 439/411–414, 709, 439/521; 29/855, 848, 871

[56] References Cited

U.S. PATENT DOCUMENTS

| | | | |
|---|---|---|---|
| D. 315,566 | 3/1991 | De Luca et al. | D14/256 |
| D. 331,224 | 11/1992 | Robertson | D13/147 |
| D. 335,486 | 5/1993 | Fatalo | D13/147 |
| D. 335,487 | 5/1993 | Volk et al. | D13/147 |
| D. 346,789 | 5/1994 | Sanchez et al. | D13/147 |
| D. 353,365 | 12/1994 | Marach | D13/147 |
| 4,159,159 | 6/1979 | Kaucic et al. | 339/198 H |
| 4,210,379 | 7/1980 | Vachhani et al. | 439/411 |
| 4,652,070 | 3/1987 | Suffi | 339/97 P |
| 4,652,071 | 3/1987 | DeBortoli et al. | 339/99 R |
| 4,688,872 | 8/1987 | Pohl | 439/404 |
| 4,734,061 | 3/1988 | Randall, Jr. et al. | 439/709 |
| 4,795,363 | 1/1989 | Scherer et al. | 439/395 |
| 4,795,364 | 1/1989 | Frantum, Jr. et al. | 439/407 |
| 4,846,721 | 7/1989 | Debruycker et al. | 439/411 |
| 4,971,573 | 11/1990 | Pinyan | 439/412 |
| 4,993,966 | 2/1991 | Levy | 439/411 |
| 5,139,440 | 8/1992 | Volk et al. | 439/413 |
| 5,149,278 | 9/1992 | Waas et al. | 439/412 |
| 5,423,694 | 6/1995 | Jensen et al. | 439/417 |
| 5,551,889 | 9/1996 | Kozel et al. | 439/412 X |
| 5,571,029 | 11/1996 | Poissant et al. | 439/412 |

*Primary Examiner*—Hien Vu
*Attorney, Agent, or Firm*—Jones, Day, Reavis & Pogue

[57] ABSTRACT

Briefly, and in accordance with the foregoing, the present invention envisions a novel terminal block assembly. The terminal block assembly of the present invention contains a dielectric material to provide environmental protection of a connector and a conductor when coupled to the connector. A dielectric protection system protects the dielectric material from detrimental environmental effects. Additionally, the terminal block assembly is configured to maintain the dielectric material in close contact with the connector without applying compressive forces thereto.

26 Claims, 10 Drawing Sheets

TERMINAL BLOCK

CROSS REFERENCE

This patent application claims the benefit of priority of co-pending United States Provisional Application Ser. No. 60/028,859 filed Oct. 16, 1996.

BACKGROUND

The present invention relates generally to terminal block assemblies for use in connecting telecommunications service lines and telecommunications distribution lines, and relates more specifically to a novel terminal block assembly.

A variety of terminal blocks have been devised which connect lines using such devices such as insulation displacement connectors ("IDC"). These terminal blocks may have one or a multiple of connectors. The following U.S. patents, show in one form or another, terminal blocks which connect conductors or wires to provide an electrical contact with a conductive terminal such as a threaded wire wrap type terminal. These United States patents include: U.S. Pat. No. 5,639,992 issued Jun. 17, 1997, to Debbaut; U.S. Pat. No. 5,357,057 issued Oct. 18, 1994, to Debbaut; U.S. Pat. No. 5,140,746 issued Aug. 25, 1992, to Debbaut; U.S. Pat. No. 4,864,725 issued Sep. 12, 1989, to Debbaut; U.S. Pat. No. 4,634,207 issued Jan. 6, 1987, to Debbaut; U.S. Pat. No. 4,600,261 issued Jul. 15, 1986, to Debbaut; U.S. Pat. No. 4,993,966 issued Feb. 19, 1991, to Levy; and U.S. Pat. No. 5,149,278 issued Sep. 22, 1992, to Waas.

Several patents, such as U.S. Pat. Nos. 4,600,261; 4,634,207; 4,864,725; 5,140,746; and 5,357,057 (the "Debbaut" patents) show a terminal block in which a gel is cured in a housing component. The housing having the cured gel therein is positioned over and forced upon a substrate including conductive connecting elements. The force on the housing causes the gel to elastically deform over the connector element. In other words, the gel is of such a composition that it is stretched over the conductive connector.

In a similar manner, U.S. Pat. No. 5,149,278 (the "Waas" patent) and U.S. Pat. No. 4,993,966 (the "Levy" patent) forces the gel over the conductive connectors disclosed therein. The Debbaut patents, the Waas patent and the Levy patent operate under the theory that forcing the gel over a conductive connector creates a tight seal therewith. However, in order to remove a wire from the conductive connector, the pre-cured gel must be removed from the connector.

As might be expected, removal of the gel from the connector can introduce environmental problems which the use of the gel is originally intended to prevent. For example, when the gel is removed from the conductive connector, moisture, particles and other detrimental environmental effects can contact the conductive connector. When the gel is once again forced over the conductive connector, these detrimental environmental effects are trapped under the seal of the gel and maintained in contact with the conductive connector. As such, the devices in these patents tend to create, perpetuate and exacerbate a problem which they were intended to prevent.

As an additional matter, the devices in these patents depend upon a force device to compress the gel into close contact with conductive connector. Such forces are undesirable over a long period of time. For example, if the force mechanism fails, the conductive contact may be exposed to detrimental environmental effects. The force mechanism may fail because in maintaining a force for a long period of time may stress the structure containing the gel thereby increasing the likelihood of failure. As such, it would be desirable to provide a terminal block device which eliminates the need for maintaining compressive contact or forces on the gel to produce a desired protective function.

Additionally, the devices as shown in the patents mentioned hereinabove create zones of weakness or planes of weakness in the gel. For example, although these devices are intended to stretch or elastically deform the gel over the conductive contact, this does not always happen. As might be expected, a conductive contact may have sharp or pointed surfaces which may tend to sever or tear the gel. A zone or plane of weakness or failure forms along the tear line. Such tear line may eventually seal sufficiently to prevent detrimental environmental effects. However, prior to sealing, such effects may take place along the zone of weakness or plane of weakness thereby initiating a problem which is maintained or exacerbated once the gel seals.

An additional problem that is created with the prior art devices is that the forces on the gel tend to force the gel out of the housing. In other words, the forces on the gel tends to extrude the gel through openings or gaps in the housing. Because these extruded or bulged portions of the gel are constantly exposed, they may be a point of collection of particles, insects, moisture and other detrimental environmental substances. Such substances may tend to form a layer on the gel and maintain this layer in close position relative to the conductive contacts. When the gel is removed from the conductive contact for repair or reconnection, this layer of detrimental substances may become positioned against the conductive contact. Such substances may then, ultimately be sealed against the conductive contact. As such, it is desirable to provide a terminal block assembly which will prevent the accumulation of detrimental environmental substances to prevent the substances from contacting the conductive connector.

OBJECTS AND SUMMARY

An object of the present invention is to provide a terminal block which will protect a conductive contact between a conductor and a connector from detrimental environmental effects.

Another object of the present invention is to provide a terminal block assembly which protects a non-conductive dielectric environmental protectant from detrimental environmental effects.

A further object of the present invention is to provide a terminal block which does not apply stresses to the dielectric material retained therein to maintain a protective covering of the dielectric over the conductive contact.

Briefly, and in accordance with the foregoing, the present invention envisions a novel terminal block assembly. The terminal block assembly of the present invention contains a dielectric material to provide environmental protection of a connector and a conductor when coupled to the connector. A dielectric protection system protects the dielectric material from detrimental environmental effects. Additionally, the terminal block assembly is configured to maintain the dielectric material in close contact with the connector without applying compressive forces thereto.

BRIEF DESCRIPTION OF THE DRAWINGS

The organization and manner of the structure and function of the invention, together with the further objects and advantages thereof, may be understood by reference to the following description taken in connection with the accompanying drawings, wherein like reference numerals identify like elements, and in which:

FIGS. 11 and 12 are partial fragmentary, cross-sectional, elevational views taken along lines 11—11 and 12—12 in FIG. 9 and in which FIG. 11 shows the actuator in a "disengaged" position in which wires may be inserted into the terminal block assembly and into the actuator and are not engaged with corresponding conductive clips, and FIG. 12 shows the actuator in an "engaged" position after movement of the actuator driver to downwardly displace the actuator causing the wires carried therein to be displaced into engagement with the conductive clip;

FIGS. 13 and 14 are partial fragmentary, cross-sectional, elevational views taken along lines 13—13 and 14—14 in FIG. 9 and in which FIG. 13 shows the actuator in a disengaged position as shown in FIG. 11 and FIG. 14 shows the actuator after movement of the actuator driver to downwardly displace the actuator engaged therewith to an engaged position as shown in FIG. 12;

FIGS. 15 and 16 are partial fragmentary, cross-sectional, side-elevational views taken along lines 15—15 and 16—16 in FIG. 9 and in which FIG. 15 shows an actuator in a disengaged position as shown in FIGS. 11 and 13 and FIG. 16 shows the actuator after movement of the actuator driver to downwardly displace the actuator engaged therewith to an engaged position as shown in FIGS. 12 and 14;

FIGS. 17 and 18 are partial fragmentary, cross-sectional, elevational views taken along lines 17—17 and 18—18 in FIG. 9 and in which FIG. 17 shows a portion of the actuator in a disengaged position as shown in FIGS. 11, 13 and 15 and FIG. 18 shows the actuator after movement of the actuator driver to downwardly displace the actuator engaged therewith to an engaged position as shown in FIGS. 12, 14 and 16;

DESCRIPTION

Figure 1:
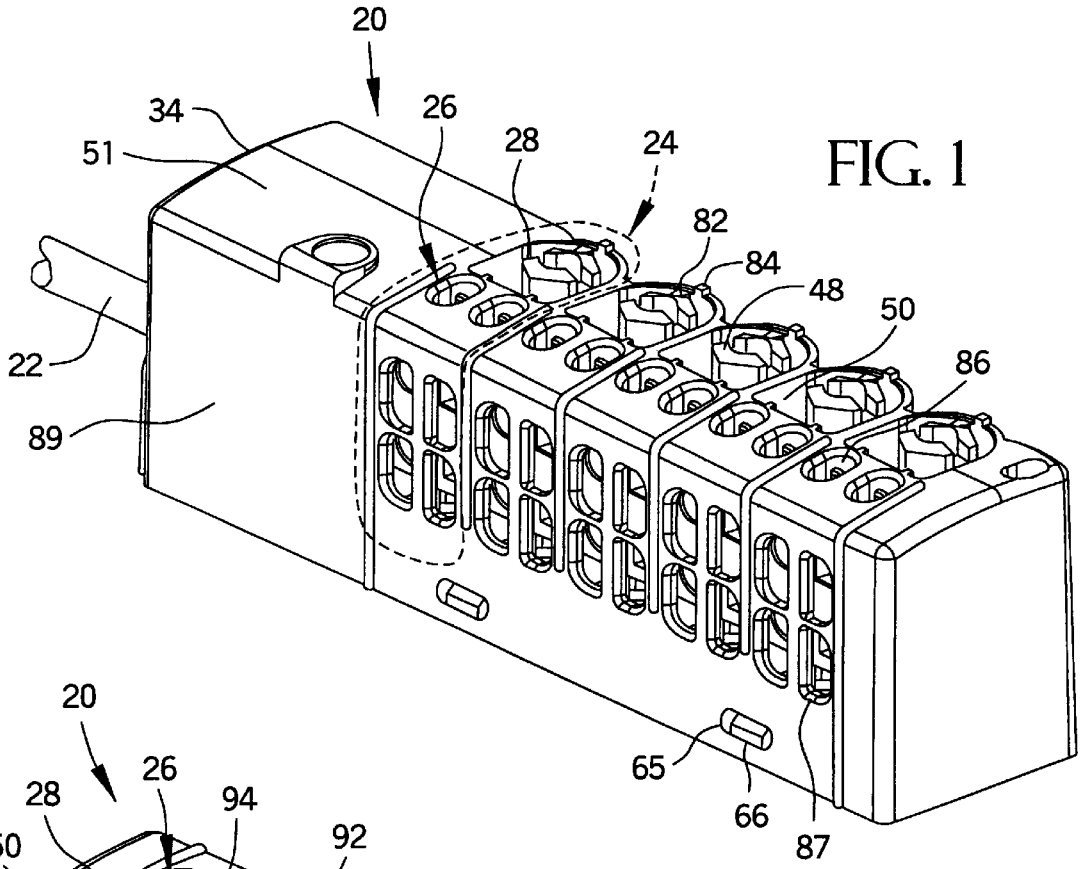
FIG. 1 is a front, right side, top perspective view of a terminal block assembly of the present invention.
Figure 2:
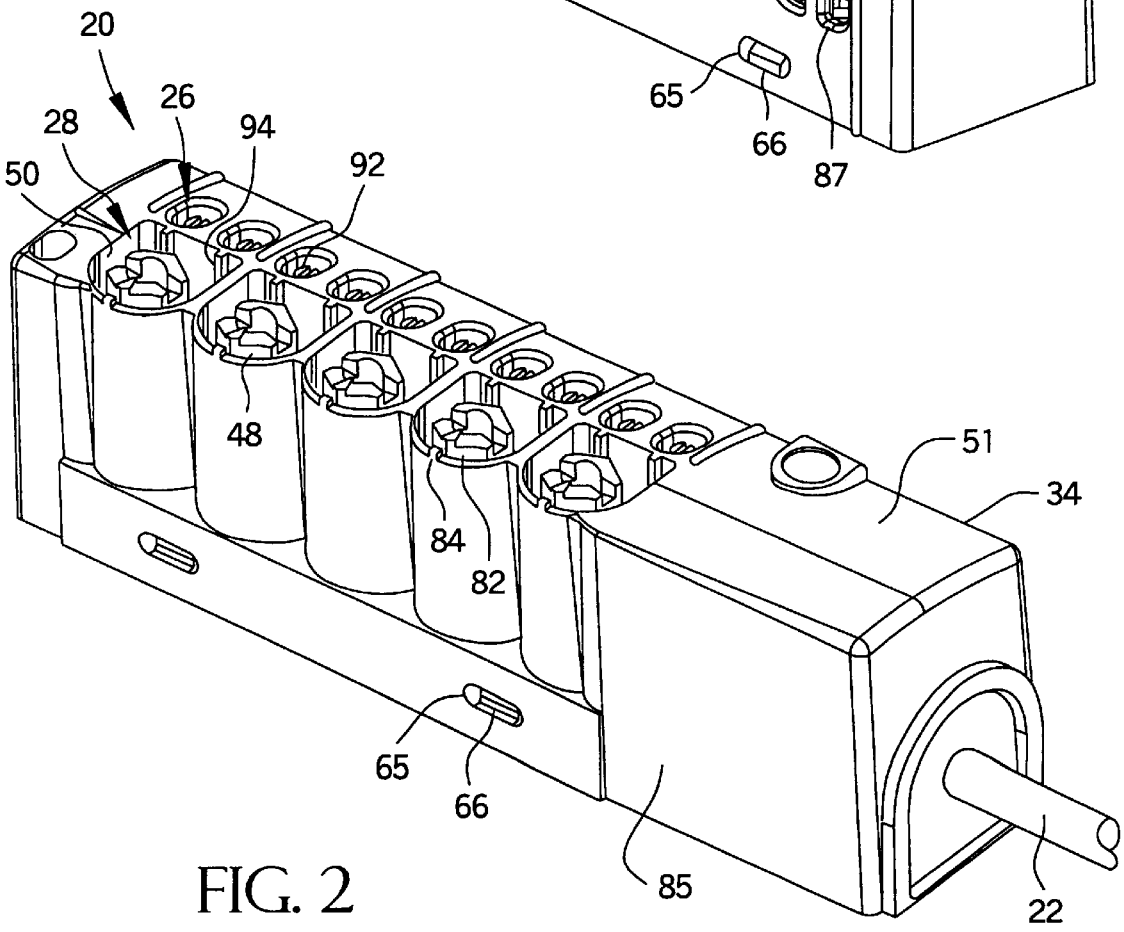
FIG. 2 is a rear, left side, top elevational view of the terminal block assembly as shown in FIG. 1.
Figure 3:
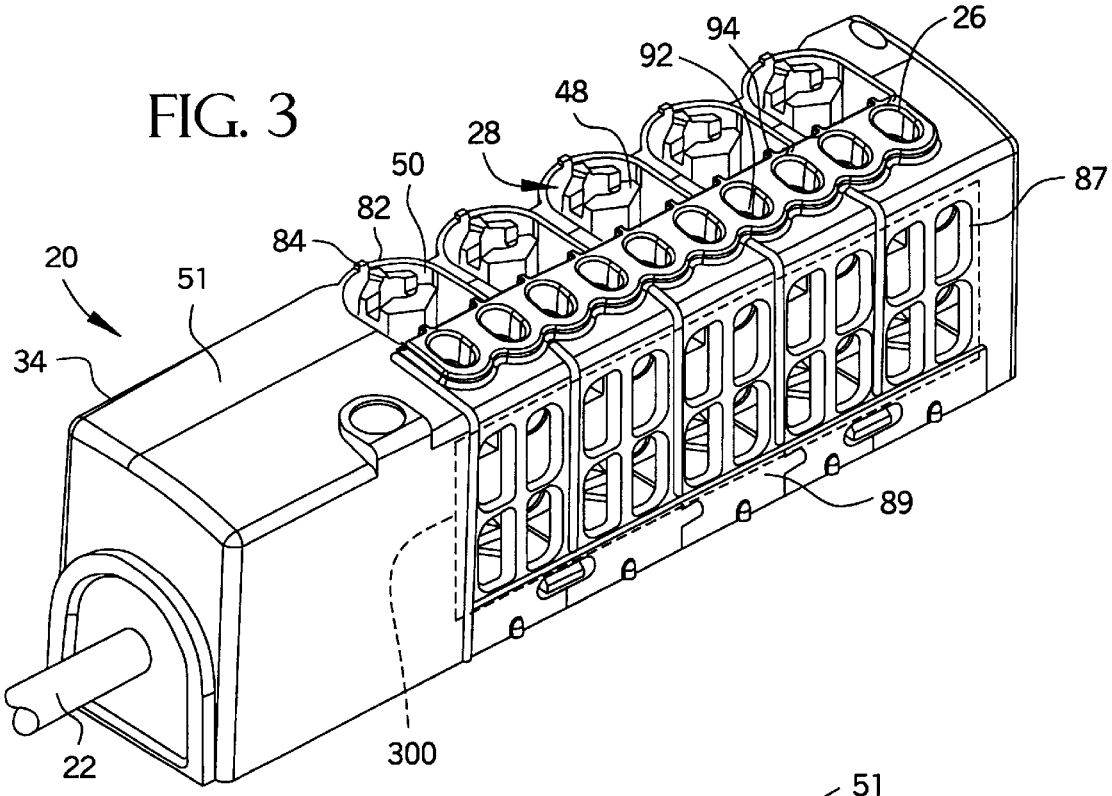
FIG. 3 is a front, left side, top perspective view of the terminal block assembly.
Figure 4:
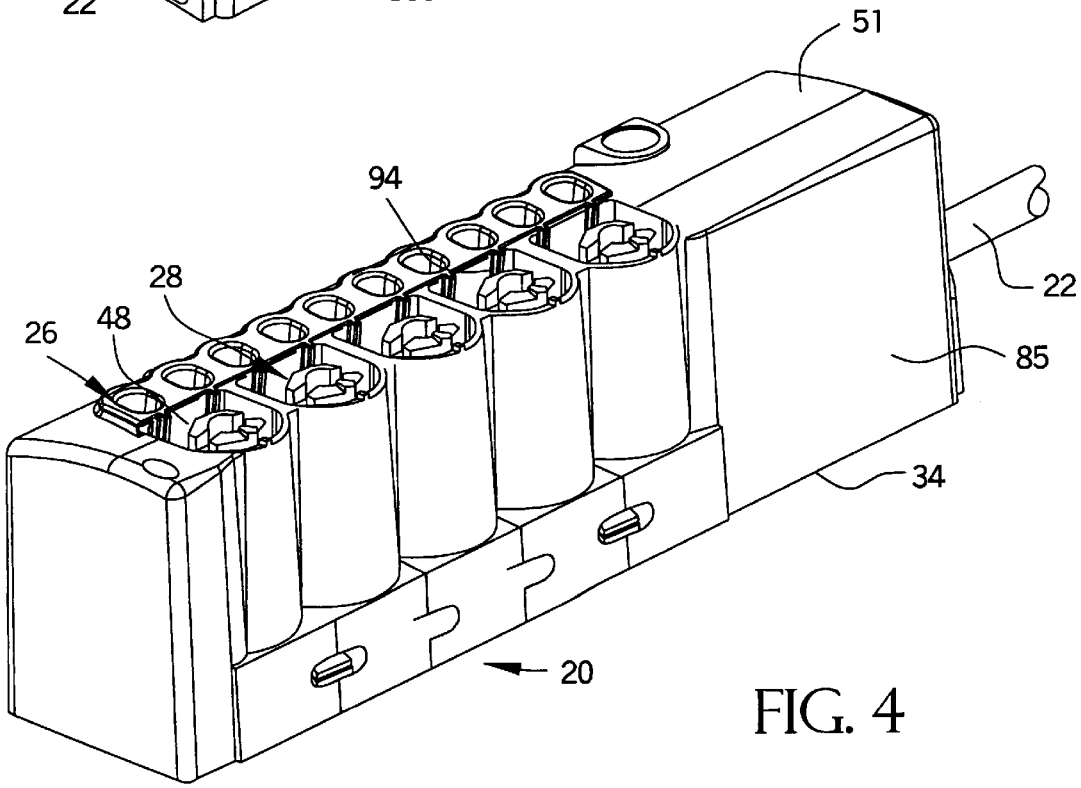
FIG. 4 is a rear, right side, top perspective view of the terminal block assembly.
Figure 5:
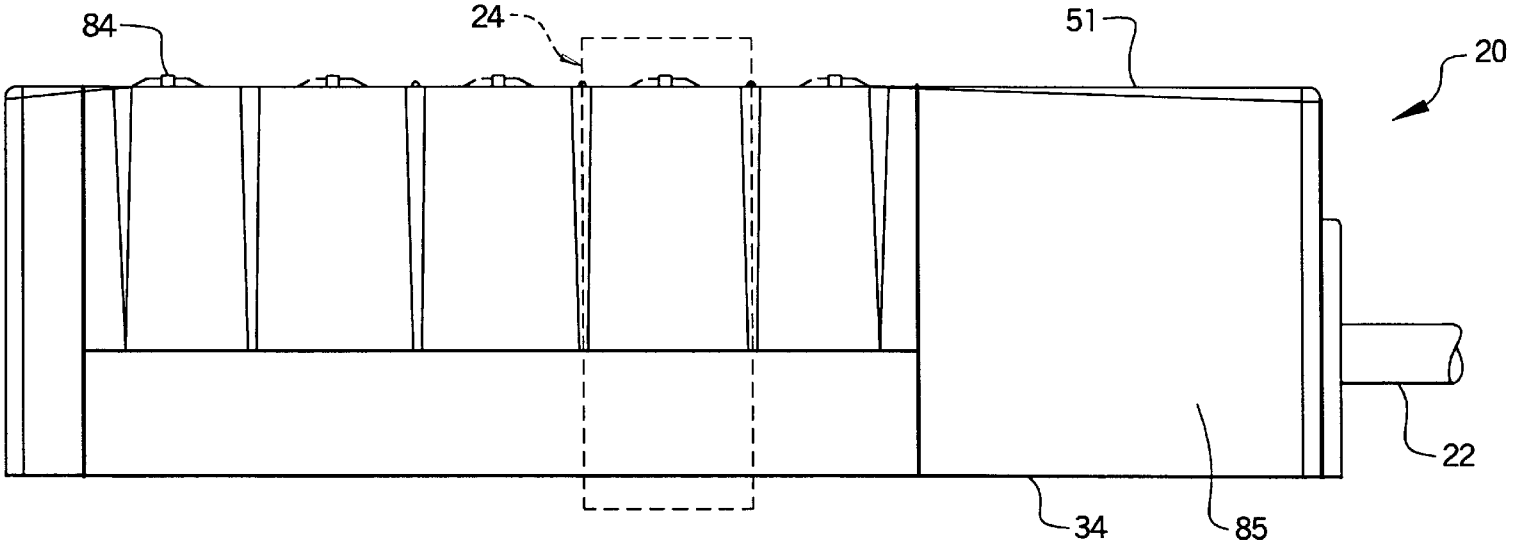
FIG. 5 is a rear elevational view of the terminal block assembly as shown in FIGS. 1–4.
Figure 7:
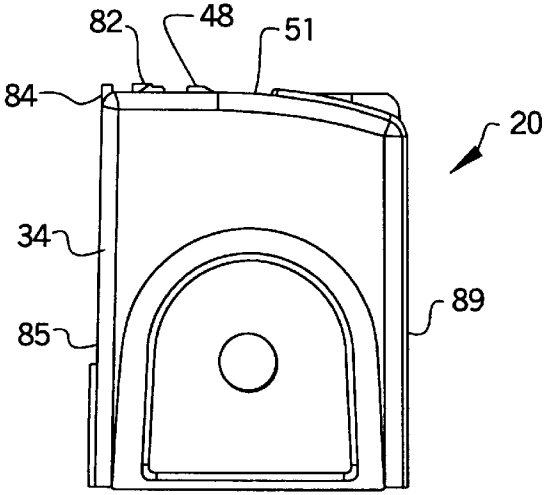
FIG. 7 is a left side elevational view of the terminal block assembly.
Figure 6:
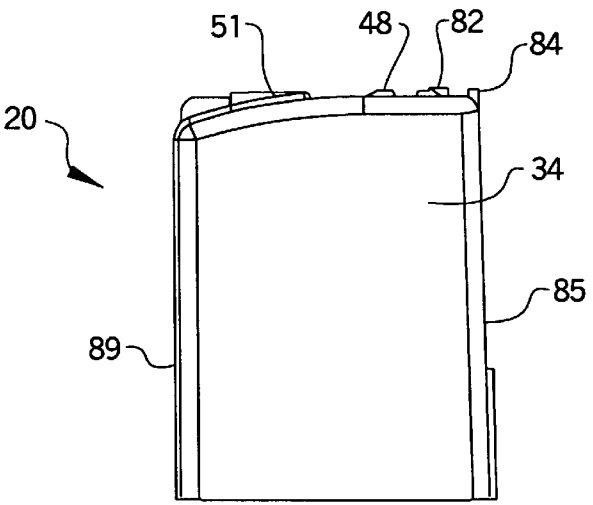
FIG. 6 is a right side elevational view of the terminal block assembly.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 8:
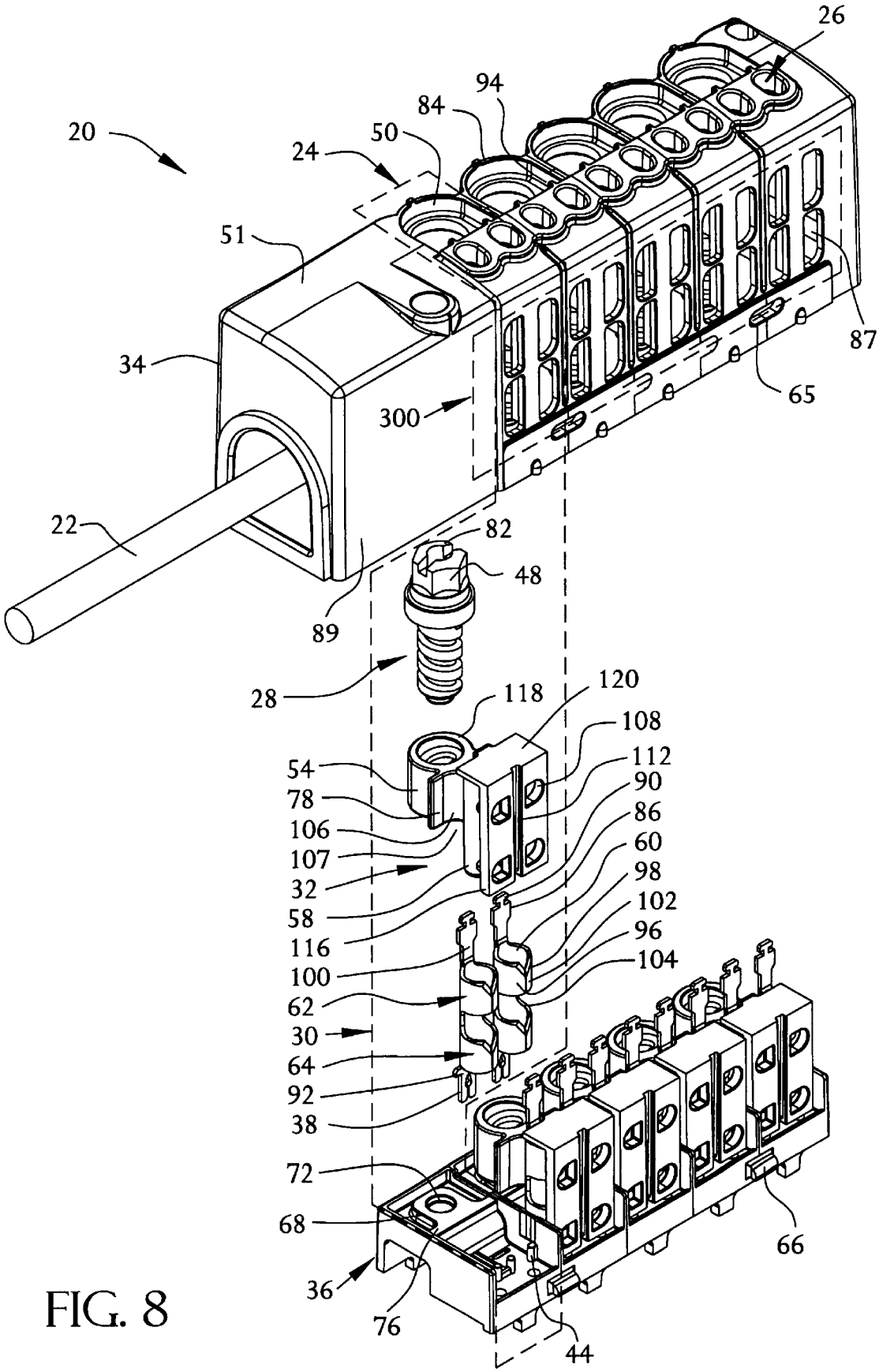
FIG. 8 is an exploded front, left side, top perspective view of the terminal block assembly similar to the perspective view as shown in FIG. 3 in which actuator drivers, actuators, barrel insulation displacement connector clips, and a base have been exploded away from a housing of the terminal block assembly.
Figure 9:
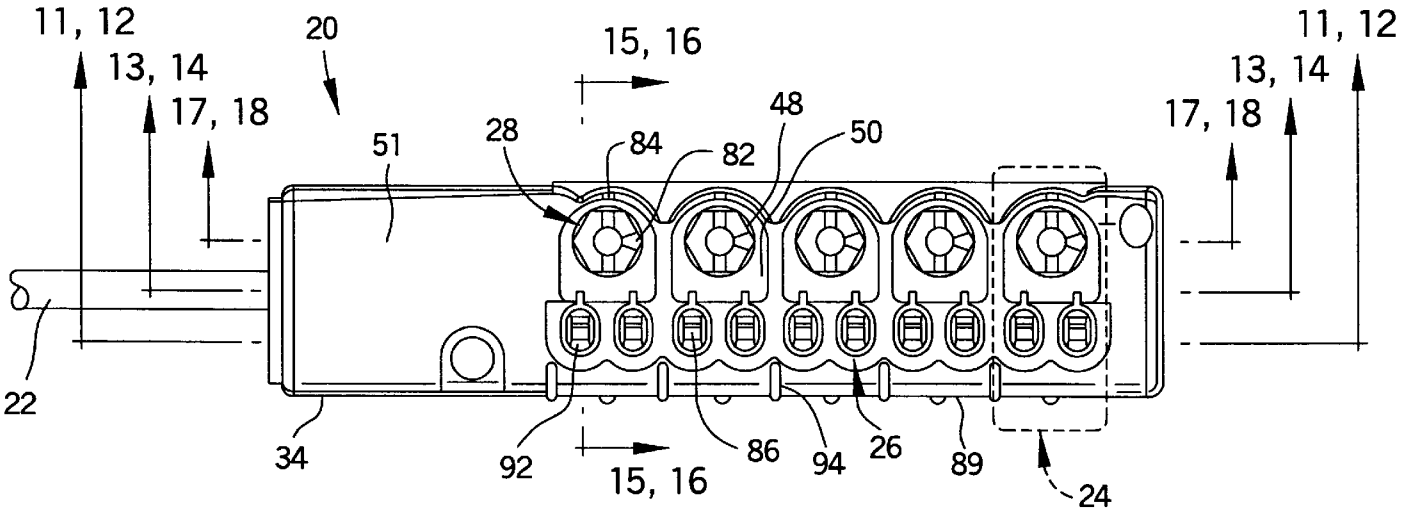
FIG. 9 is a top plan view of the terminal block assembly.
Figure 10:
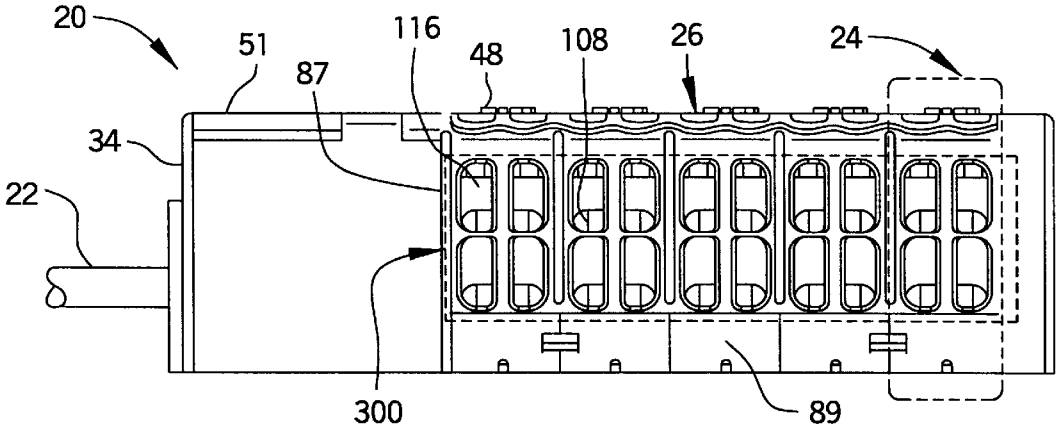
FIG. 10 is a front elevational view of the terminal block assembly.
Figure 11:
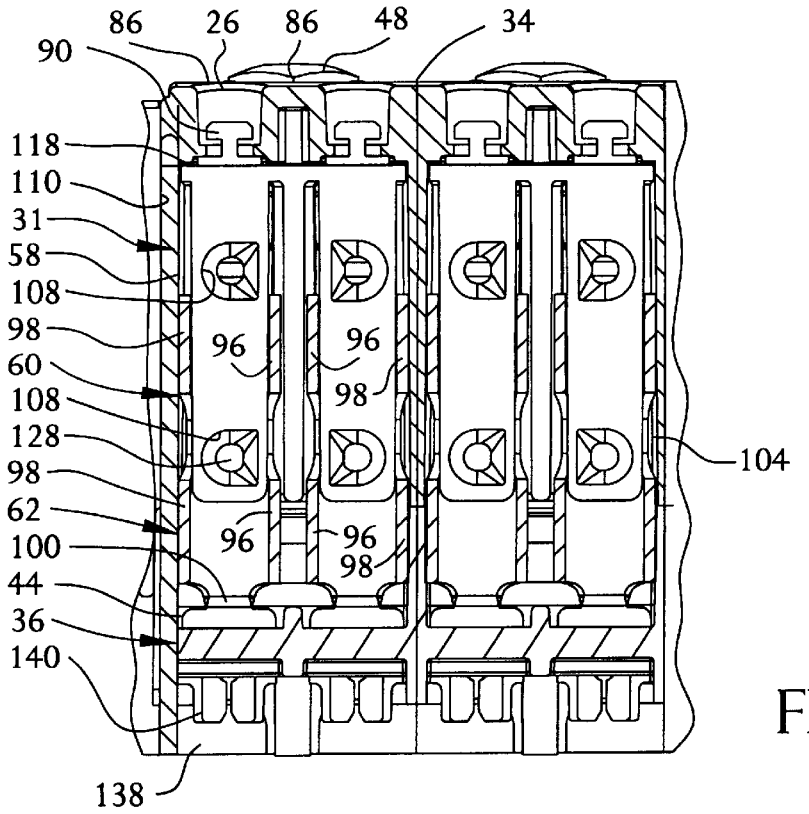
Figure 12:
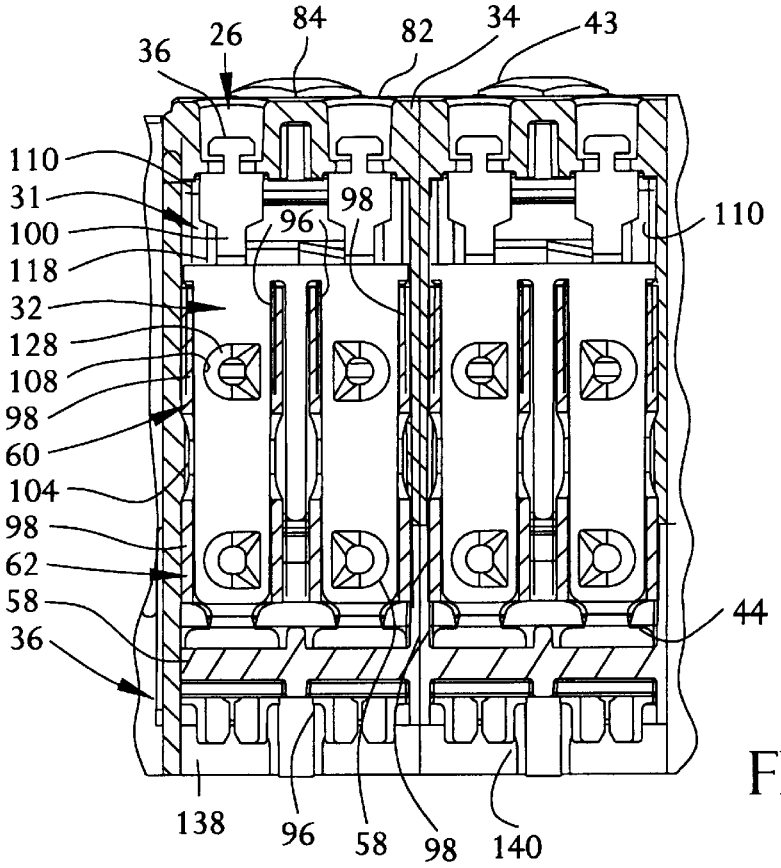
Figure 13:
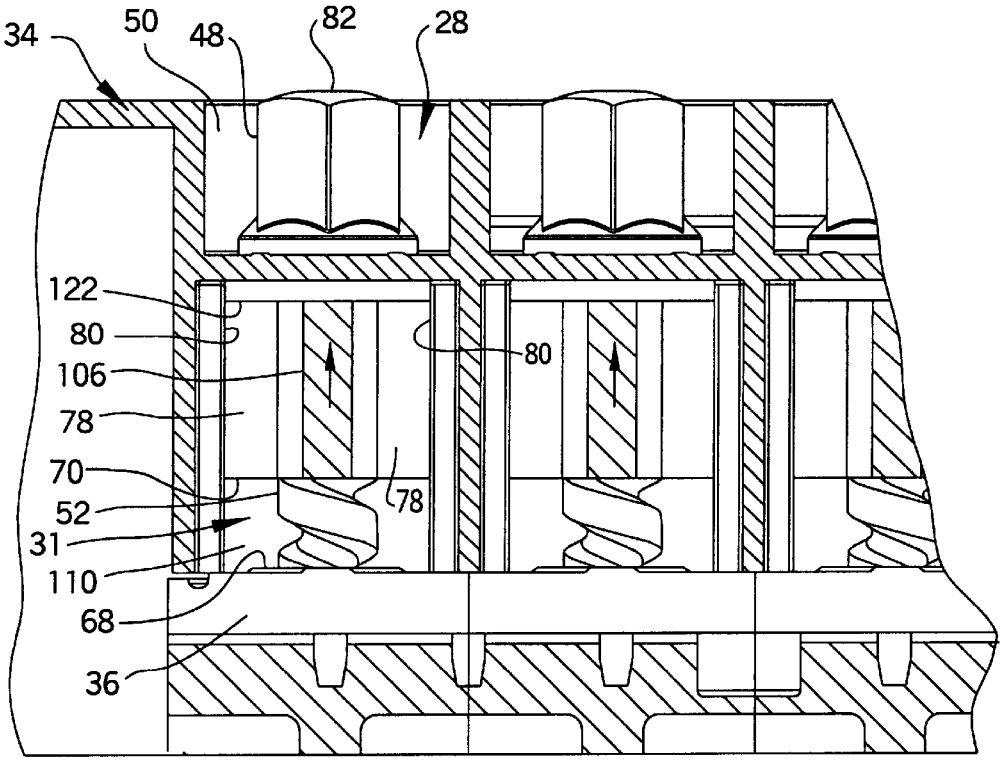
Figure 14:
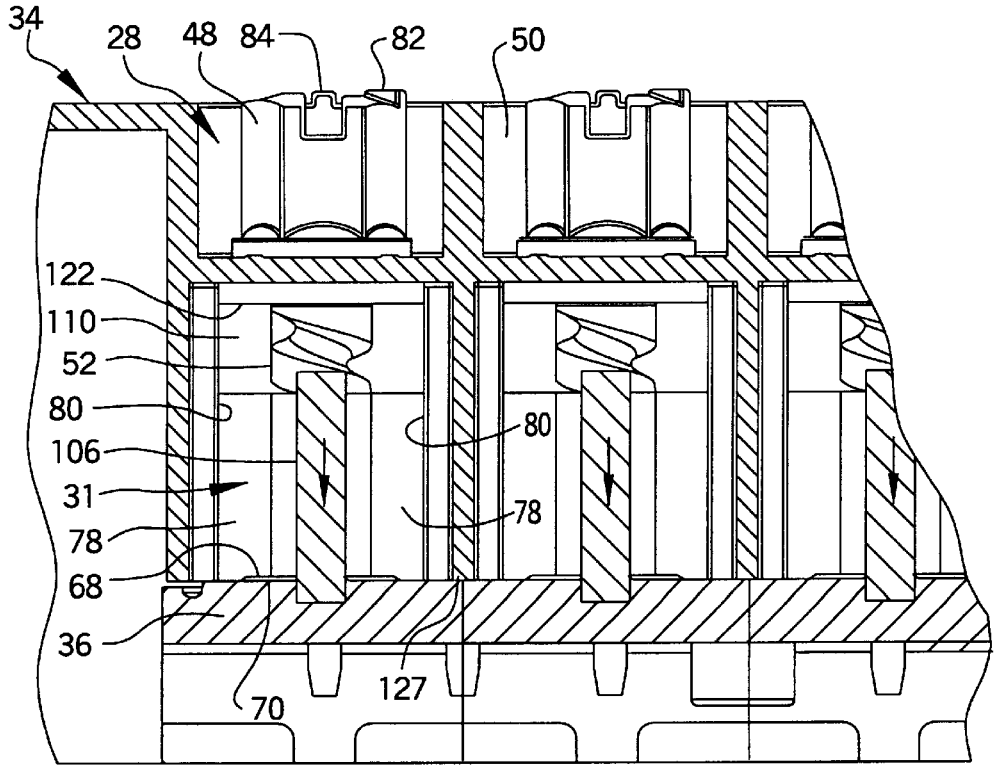

As shown in FIGS. 1–4, the present invention is a terminal block 20 which is shown connected to a distribution cable 22 carrying a plurality of individual conductive members, conductors or distribution lines therein. The terminal block 20 includes a plurality of interconnection assemblies 24 to which pairs or multiple pairs of conductors may be connected and/or interconnected. A representative interconnection assembly 24 is shown in FIGS. 1 and 8 by the broken line border. The interconnection assemblies 24 also include test ports 26 for continuity testing of the conductive components of the terminal block and an accessible actuator driver 28 as will be described in greater detail hereinbelow.

The overall design of the exterior of the housing is ornamental to provide an appearance which is appealing and distinctive and will become recognizable by the relevant purchasers of such products as a product of the Assignee of the present invention. The novel structures and functions of the present invention will be described in greater detail with regard to the components as generally shown in the exploded view of FIG. 8.

With reference to FIG. 8, the exploded view shows that there are only a few components to each of the interconnection assemblies 24. Each interconnection assembly 24 includes a pair of barrel insulation displacement connector clips, conductive connectors or barrel clips 30 which are engaged with an actuator 32 which is threadedly engaged with the actuator driver 28. The actuator driver 28, actuator 32, and barrel clips 30 are retained in a cavity 31 defined between a housing portion 34 and a base portion 36. As such, in one aspect, the terminal block 20 of the present invention has been refined to minimize the number of components and to maximize the efficiency of assembly and reliability of the construction of the structures.

Figure 16:
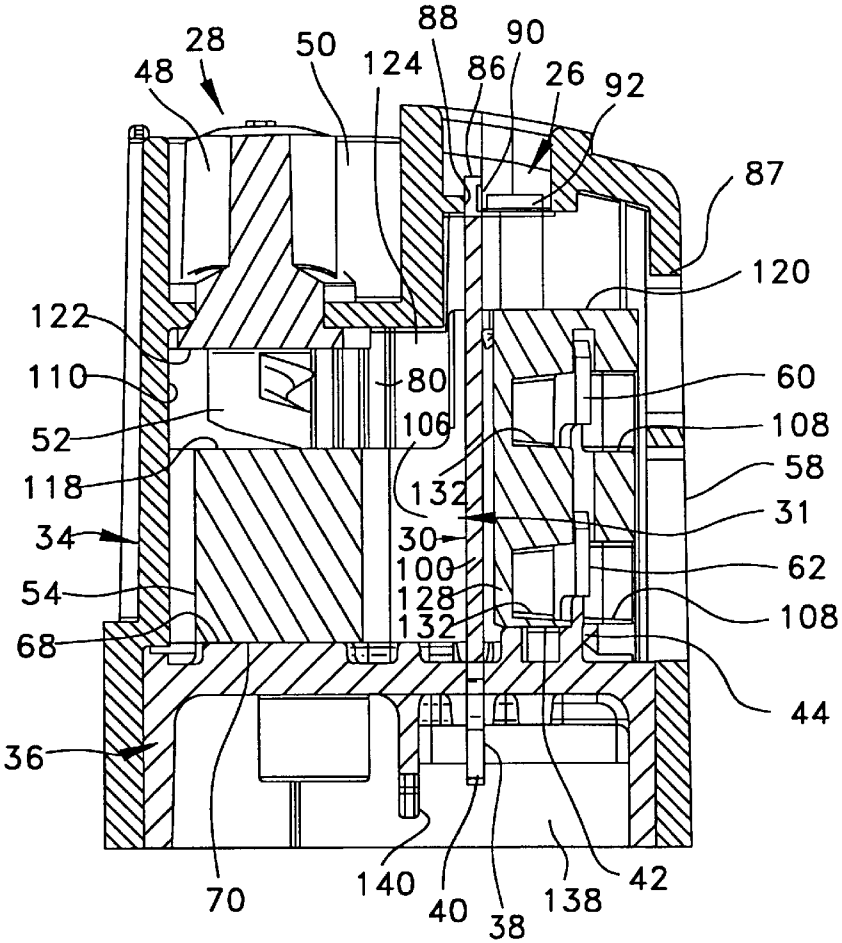
Figure 15:
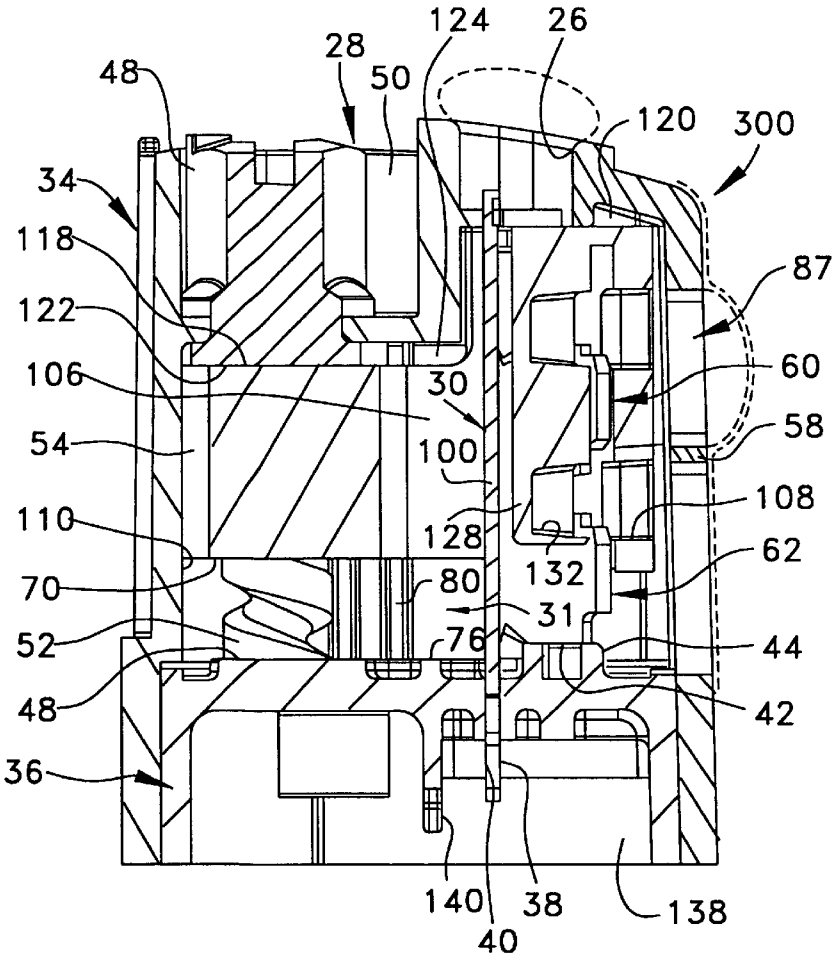

With further reference to FIGS. 15 and 16, it can be seen that a bottom prong portion 38 is inserted into a corresponding aperture 40 in the base 36 in order to stake the barrel clip 30 to the base 36. A lower portion 42 of the barrel clip 30 abuts a barrel clip foundation structure 44 formed in the base 36. Retention of the bottom prong portion 38 in the aperture 40 and abutment of the lower portion 42 against the foundation 44 provides an added degree of stability for the barrel clips 30 retained on the base 36. It should be noted that during the assembly process, the barrel clips 30 are staked to the base 36 and the stability of the present structures provides ease and efficiency in handling the clips 30 retained on the base 36 during the assembly process.

Figure 17:
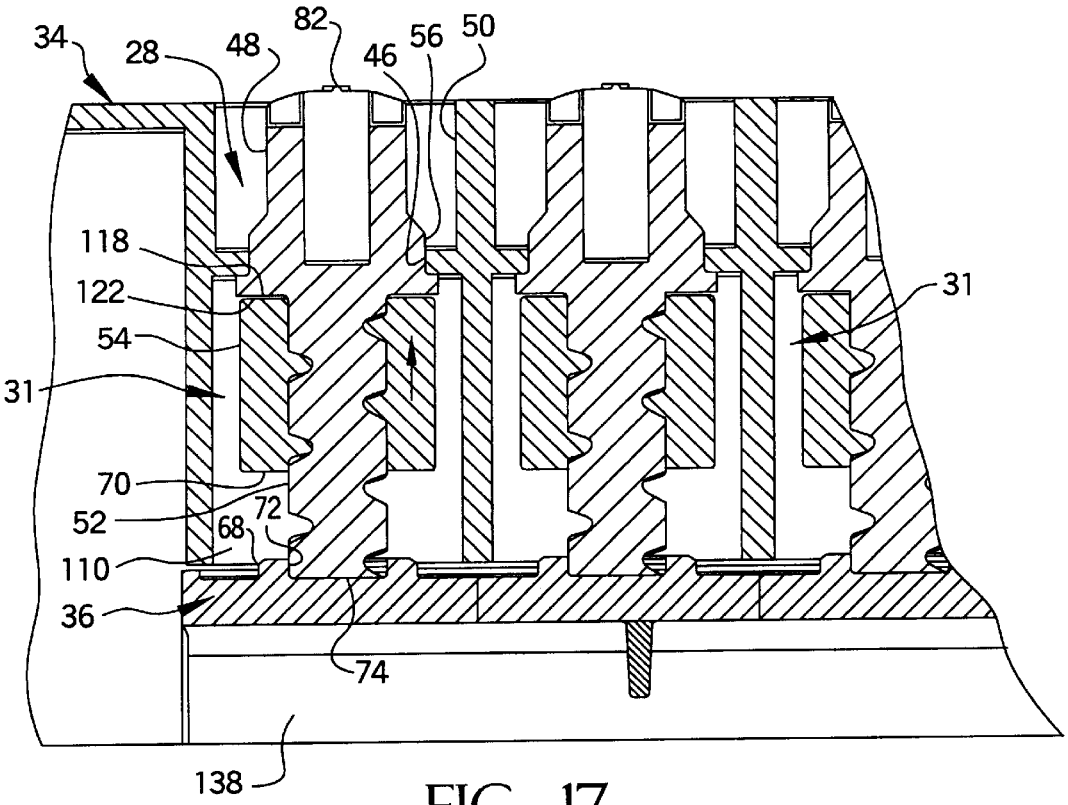
Figure 18:
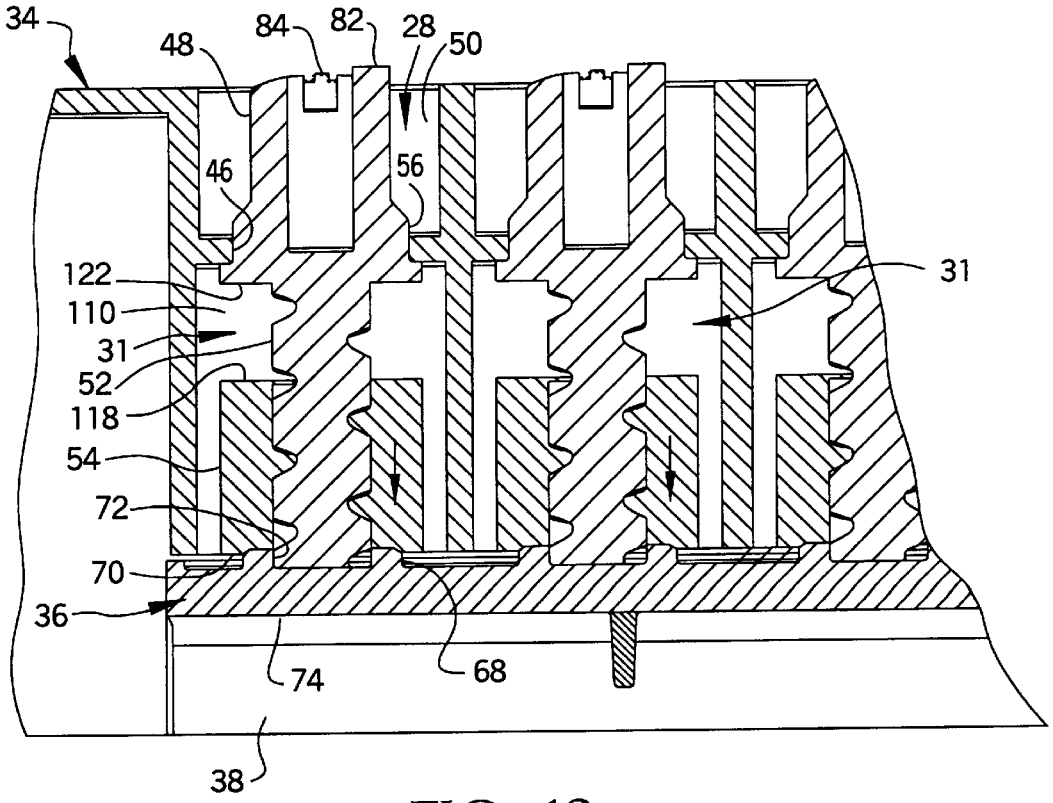

With further reference to FIGS. 8, 17 and 18, it can be seen that the threaded actuator driver 28 is retained within a bore 46 in the housing 34 having a drive head portion 48 positioned in a driver well 50 in the top side 51 of the housing 34. A threaded portion 52 of the driver 28 is engaged with a threaded body portion 54. The drive head 48 has a shoulder 56 which abuts an inside surface of the housing and is sized and dimensioned to aid in preventing wobbling of the driver 28 in the housing 34.

During the assembly process, the driver 28 is threadedly engaged with the threaded portion 52 of the correspondingly threaded body 54 of the actuator 32. As will be described in greater detail hereinbelow, the actuator 32 includes a post 58 depending therefrom. The post 58 extends axially through a passage 60 defined by a first 62 and second 64 arm or spring portion of the barrel clip 30. As such, the clips 30 have been mounted to the base 36 and the actuator 32 is placed thereover having the actuator driver 28 threadedly engaged with the actuator 32.

As might be appreciated based on the foregoing description, the assembly of the present invention is quite efficient and uncomplicated. The next step in the assembly process is to invert the housing 34. The driver 28 and actuator 32 are placed in the housing with the head 48 of the driver extending through the bore 46. The components 30, 32, 28 retained on the base 36 are inverted and positioned in the cavity with the post 58 positioned in the passage 60. The base 36 is then securely attached to the housing 34 by means of openings 65 positioned on the housing to engage a correspondingly positioned snap fit tab 66 formed on the base 36. As assembled, in accordance with the description provided hereinabove, the terminal block 20 is prepared to receive a distribution cable 22 and, thereafter, conductors engaged with selected interconnection assemblies 24.

As discussed above, the stability and integrity of the structures have been considered in the present invention and refined to provide a high degree of stability and integrity of the structures. As noted above, the lower portion 42 of each barrel clip 30 is positioned against a barrel clip foundation 44. With further reference to FIGS. 15 and 16, it can be seen that a similar structure, namely a threaded body foundation 68 is provided on the base 36 corresponding to a lower portion 70 of the threaded body 54. The foundation 68 includes a driver recess 72 which receives a tip portion 74 of the threaded portion 52 of the driver 28. The driver recess 72 provides an added degree of stability by retaining the tip portion 74 of the driver 28 generally axially aligned with the bore 46. The recess 72 provides a positive stop for the driver to help prevent canting of the driver 28 thereby improving the ease of rotation of the driver 28 as will be described in greater detail hereinbelow. A pair of guide flanges 78 extend outwardly relative to the threaded body 54. The guide flanges 78 are engaged in corresponding channels 80. The guide flanges 78 engage the channels 80 in order to provide stability of the actuator 32 as it is upwardly and downwardly moved to engage or disengage conductor from the barrel clip 30.

The aforementioned foundation structures 44, 68 provide a positive stop when a tradesperson rotates the driver 28 to downwardly displace the actuator 32. Further, the structures also help to add rigidity to enhance the strength of the base 36. In this regard, even if one attempts to overtighten the driver 28, the structures strengthen the base 36 and help prevent disengagement of the base 36 from the housing 34. Additionally, the top of the driver head 48 is provided with an indicator 82 which is aligned with a reference point 84 on a corresponding portion of the rear side 85 of the housing 34. The indicator 82 aligns with the reference point 84 when the actuator 32 is in the upwardly displaced second position. This indicates to the tradesperson that they can insert a wire into a desired receptacle 87 of the interconnection assembly 24 on the front side 89 of the housing 34 and rotate the driver 28 to engage the wire with the conductor clips 30. The tradesperson need only rotate the driver 28 one full rotation, 360°, to position the actuator 32 in the downwardly displaced first position. In the downwardly displaced first position, the actuator forces a conductor carried therein through a corresponding spring portion 60,62 of the clip 30. The indicator and reference point 82,84 also help prevents overtightening of the driver 28.

Figure 21:
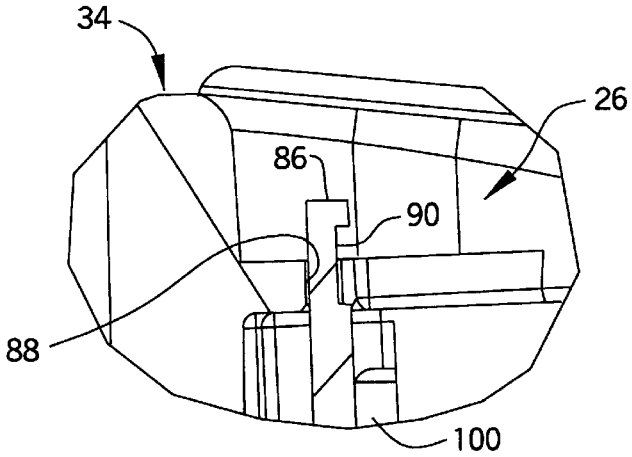
FIG. 21 is an enlarged, partial fragmentary, cross-sectional, side-elevational view taken along line 21—21 in FIG. 20 showing a test tip portion of the barrel insulation displacement connector clip which extends upwardly from a test port in the housing of the terminal block assembly for improved engagement with a testing equipment clip which may be attached thereto.
Figure 20:
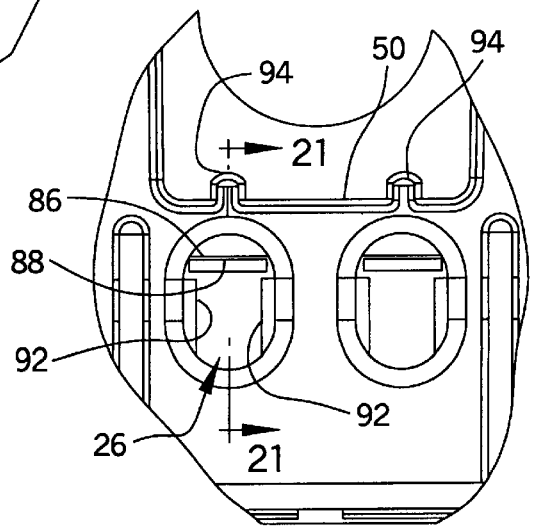
FIG. 20 is a partial fragmentary, top plan view of a test port.

Each of the barrel clips 30 includes a test point 86 which extends through an opening 88 in each of the corresponding test ports 26. With further reference to FIGS. 20 and 21, FIG. 20 provides a plan view of a test port 26 and FIG. 21 provides a cross-sectional view of the test port 26 taken along line 21—21 in FIG. 20. The test point 86 extends upwardly from the housing 34 into the test port 26. The test port 26 is a recessed area in the housing 34 which prevents accidental contact with the test point 86. The test point 86 also includes a slot 90 which facilitate positive engagement of an alligator-type test clip thereto. To further facilitate ease of use of standard alligator-type test clips, guide flanges 92 have been provided on each side of the test port 26 to direct the test clip into alignment and engagement with the test point 86. Additionally, a test clip positioning rib 94 is provided in the driver well 50 which helps to positively engage and position an opposing jaw of an alligator-type clip. As such, the test point 86 of the present invention extends upwardly into the test port 26 for engagement by a test clip thereto. One of the most common types of test clips used by tradespersons in the industry is an alligator-type test clip. The alligator-type test clip is positioned with a first jaw in the test port 26 contacting and positively engaging the test point 86 generally engaging the slot 90 thereof. The second jaw of the alligator-type test clip is positioned in the driver well 50 and is positively positioned opposite the first jaw by the positioning rib 94 which protrudes into the well 50.

Figure 19:
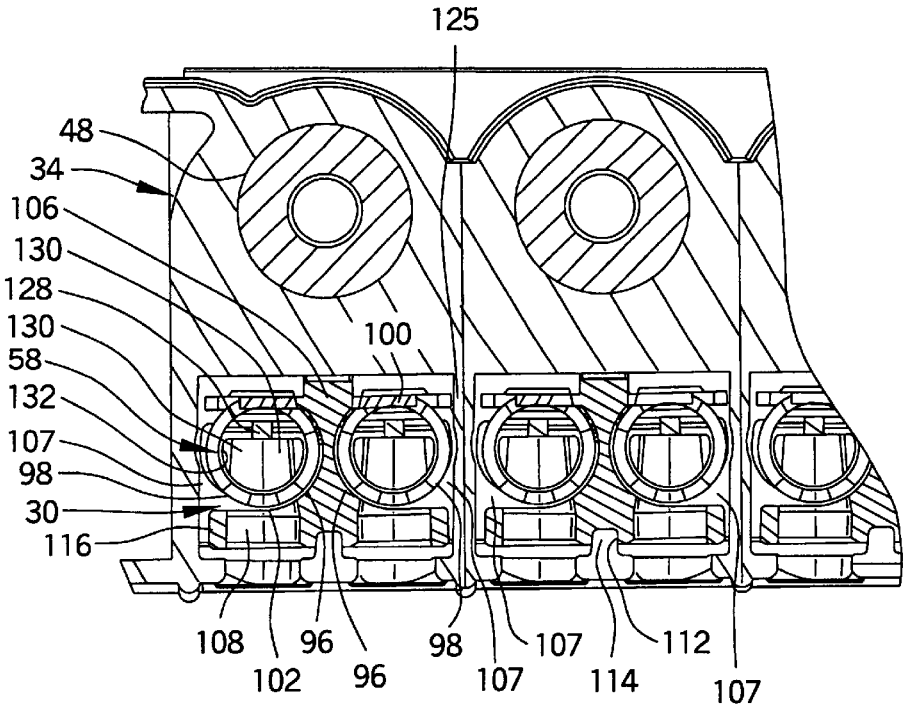
FIG. 19 is a partial fragmentary, cross-sectional, top plan view taken along line 19—19 in FIG. 10.

As previously and briefly discussed hereinabove, the present invention employs a barrel clip 30 having a pair of spring portions 60, 62. The first spring portion 60 is positioned above the second spring portion 62. With further reference to FIG. 8, each spring portion 60, 62 includes a left and right arm 96, 98. The left and right arms 96, 98 extend from a common spine 100 and forwardly curve around with opposing edges of each of the arms 96, 98 defining a contact slot 102 therebetween. A cross slot 104 is defined in the area between the first and second spring portions 62, 64. With further reference to FIG. 19, it can be seen that there is sufficient clearance between a bridge portion 106 of the actuator 32 and an outside surface of the arms positioned in close proximity thereto to allow for spreading of the respective left and right arms 96, 98 of the barrel clip 30 when a conductor is placed in the slot 102. Further, because outboard sides 107 of the actuators 32 are open and not enclosed, the barrel clips 30 of the present invention can accommodate a broad range of conductor sizes.

The independent spring portions 62, 64 do not adversely affect each other when they receive different size wires therein. Because the inside and outside arms 96, 98 of each barrel clip 30 are allowed to move independently relative to the spine 100, a variety of wire sizes may be coupled using the present terminal block structure. In particular, the present invention can accommodate wire sizes of at least 18½ gage to 24 gage. The 18½ gage is typically referred to in the industry as a "F-drop" wire. As such, the present invention provides secure support for the spring portions 60, 62 yet provides sufficient clearances to allow the arms 96, 98 thereof to expand without interference to accommodate a variety of wire sizes. "F-drop" wire is formed with two conductors covered by an oval insulating jacket. The insulating material must be split axially relative to the conductors by the tradesperson in order to couple the wires to the respective clips. When the generally oval-shaped insulating jacket is split, the resulting portions are generally "D" shaped. With this in mind, receiving ports 108 in the actuators 32 are formed in a characteristic "D" shape which accommodate the "F-drop" wire. As such, the receiving ports 108 having a "D" shape will allow the actuator 32 to accommodate the "F-drop" wire. Prior art devices could not accommodate the "F-drop" wire as such devices typically used circular or rounded receiving ports which were too small to accommodate the "F-drop" wire.

As noted above, the present invention includes the actuator 32 which has guide flanges 78 extending from the sides thereof. The guide flanges 78 ride in the corresponding channels 80 to help guide the actuator 32 in a desired path of movement to facilitate engagement of conductors with the barrel clips 30. Movement of the threaded body portion 54 and hence the actuator 32 along the threaded portion 52 of the driver 28 also helps facilitate controlled movement of the actuator 32 within the housing 34. It should be noted that each actuator moves within a corresponding sections 110 of the cavity 31 defined between the housing 34 and the base 36. The front to back movement of the actuator 32 within the respective sections 110 is limited by the flanges 78 and the threaded body portion 54 engaged with the driver 28. Side to side movement is limited in part by positioning the post 58 in the corresponding passage 60 defined by the first and second spring portions 62,64. Side to side movement also is restricted by engagement of a face channel 112 positioned on a front end of the actuator 32 with a corresponding guide rib 114 formed on an inside surface of the housing 34. As such, the structures of the present invention prevent angular movement and deflection and hence minimize or prevent canting of the actuator 32 within the respective sections 110 and hence increase the efficiency and reliability of the movement of the actuator 32 within the corresponding sections 110.

With the foregoing description in mind, it will be appreciated that the actuator 32 of the present invention is formed more as a frame-like structure or skeleton-like structure rather than the block structures of the prior art. Prior art actuator structures in terminal blocks typically use a block structure which is mounted over a flat or prong-type installation displacement clip. In contrast, the present invention employs the frame-like structure which is positioned over and around the barrel clips 30. Instead of employing a solid block of material, the present actuator structure includes the posts 58, a forward structure 116, a threaded body 54, guide flanges 78 and a bridge portion 106 extending between the threaded body portion 54 and the forward structure 116.

A top surface 118 of the threaded body portion 54 is offset from and lower than a top portion 120 of the forward structure 116. This offset of the top surfaces 118,120 is more clearly shown in FIGS. 15 and 16. As shown in FIG. 15, the top surface 118 is moved into the uppermost or second position generally abutting an underside surface 122 of the driver head 48. In this uppermost position, the receiving ports 108 of the forward portion 116 are positioned in the uppermost position prepared for receiving a conductor therein. The offset allows the driver head 48 to be recessed within the well 50 providing the low profile design of the present invention. Additionally, by recessing the head 48 in the well 50, accidental movement of the driver 28 is prevented as well as accidental bumping of a protruding driver head 48. The actuator is sized and dimensioned relative to the sections 110 to provide a gap 124 between the bridge portion 106 and the housing 34.

In a variety of applications such as exterior uses, it is desirable to provide environmental protection for the contacts made between the conductor and the clips 30. In such applications, a dielectric material such as a non-conducting gel is disposed in the housing around the conductor and clips 30 to protect the connection from detrimental environmental effects. The gel is formed in situ in the production of the terminal block to "pot" or otherwise encapsulate the components in the gel. In the present invention, the dielectric material is placed in the cavity 31 of the housing in an uncured state. All of the components of the terminal block are immersed in the gel in its liquid, uncured state. As a result, each of the components is fully surrounded by the liquid gel which flows around the components to thoroughly encapsulate the components in the dielectric material retained within the cavity 31. In this condition, it is clear that all of the conductive components are thoroughly protected from detrimental environmental effects.

An example of a suitable dielectric gel material for use in the terminal block is Sealrite® Self-Restoring Gel LT produced by CasChem, Inc., Bayonne, N.J. The Sealrite® product has an unworked, cone penetration value of 300 dmm (ASTM D217). The Sealrite® product is an uncured gel which requires at least 30 minutes for initial curing (Brookfield DV-1, Spindle 4, 6 rpm, to 100,000 cps) and achieves full cure in 24 hours at 60° C. or in one week at 25° C. Characteristics of this gel include: bonding to itself, separable from device after bonding, easily reenterable, moisture resistance, compatibility with plastics, minimal cohesive failure after insertion and retraction, and minimal adhesive failure to device.

It should be noted that the actuator 32 is encapsulated in the dielectric material in a first position or downwardly most position as shown in FIG. 16. The encapsulation of the clips 30 with the actuator 32 in the downward most position assures that the dielectric material will cure in an unstressed state with no forces applied thereto. It is desirable to prevent applying forces to the dielectric material to prevent shearing and propagation of cracks which might allow the entry of moisture or other detrimental environmental effects. The gel of the present invention is cured in situ, around the components, not before contacting the components. No tension, compression or other deforming forces are imposed on the gel in its as-formed state. The as-formed state is also the condition in which the electrical contacts are maintained in the terminal block.

This "at rest", unstressed state of the gel in which no forces are applied to the gel is desirable and in direct contrast to the operation of the other terminal blocks. In at least one device, a body of previously cured gel is positioned over the conductive contacts and then forced downwardly over and elastically deformed or stretched over the contacts to provide an environmental seal. The problem with this prior art device is that the elastic deformation of the gel over the contacts tends to trap detrimental environmental effects between the gel and the contacts. Additionally, the imposition of forces on the dielectric material may stress or cause other problems with the dielectric material. Also, in a terminal block of the present design, such forces tend to detrimentally effect the structure of the housing. Compression of the gel against the base may cause undue stresses on the connecting structures of the base and housing and tend to force the base off of the housing.

Generally, the dielectric material encapsulating the components in the cavity will be displaced during movement of the actuator through the cavity 31. The volume of the gel within the cavity is not substantially constant. During connection of a conductive member to the terminal block, the volume of the gel in the cavity changes. The resulting effect is to displace a substantial portion of the dielectric material out of the housing. For example, approximately 15–40% of the gel may be forced out of the housing during the connection operation.

With reference to FIG. 16, the gel is retained in open areas within the cavity 31 surrounding each of the components retained in the cavity 31 and at least partially adhering thereto. As the actuator changes its degree of entry in the housing cavity as it is moved upwardly as shown in FIG. 15, the dielectric material tends to be forced upwardly and bulge out-through an upper receptacle 87 and the test port 26 on top of the housing. The bulging dielectric material is shown generally in broken line. The dielectric material is displaced during the movement of the actuator 32 from a first position 200 as shown in FIG. 16 to a second position 202 as shown in FIG. 15. Because the dielectric material adheres to the actuator to some degree, it is moved upwardly with the actuator as the actuator 32 moves from the first position 200 to the second position 202. As a result of moving with the actuator, a portion of the dielectric material is displaced out of the housing 34. However, due to the properties of the dielectric material, assuming the gel-like material form, the dielectric material merely bulges out of the housing. Because there is a degree of elasticity to the dielectric material, movement of the actuator 32 from the second position 202 to the first position 200 results in replacing or retracting the dielectric material back into the housing 34.

The bulging of the dielectric material out of the housing 34 is actually beneficial such that it assures the tradesperson that there is gel within the cavity 31. Bulging of the gel from the housing provides visual verification to the person connecting a conductive member to the terminal block that there is actually gel within the terminal block and that the gel should be sufficient to provide an environmental protective function over the newly connected conductive member.

As noted hereinabove, the dielectric material is withdrawn, replaced or retracted into the housing through the receptacle 87 and test port 26 as the actuator 32 is moved from the second position 202 to the first position 200. Retraction of the dielectric material tends to provide a recoating or recovering function which assures that the contacts made between a conductive member placed in the receptacle 87 and coupled with the clip 30 will be covered or coated with the dielectric material. It should be noted, that a portion of dielectric material tends to be drawn into the lower receptacle 87. During the downward movement of the actuator, this area is also coated or recovered by the dielectric material being drawn in through the upper receptacle 87 and the test port 26.

The frame-like structure of the actuator 32 of the present invention allows a substantial quantity of dielectric material to be placed within the cavity 31. Additionally, the frame-like structure also facilitates thorough distribution of the uncured dielectric material within the cavity 31. Thorough distribution prevents formation of pockets or gaps in the dielectric material which might otherwise occur in a cavity of smaller proportion to the components retained within the cavity. An insulating member 125 is positioned between each pair of clips 30 and each actuator 32. The insulating members 125 partition but do not separate, compartmentalize or isolate the sections 110 of the cavity. Rather, the dielectric material extends through the elongated continuous cavity of the housing and between the interconnected sections 110. Insulating member 125 is shown in FIG. 19. The insulating members of the present invention do not act as walls to contain dielectric material within a specific, discrete sections as in the prior art. The insulating member extends between neighboring clips to prevent the arm 62,64 which deflect outwardly from contacting one another. Although it is unlikely that the arms would deflect to such a degree, the insulating member 125 prevents contact of these arms. In a similar manner, the bridge 106 of the actuator 132 is positioned between each pair of clips 30,30 to prevent contact. The bridge 106 is formed of an insulating material.

As noted above, a gap 124 is provided above the bridge portion 106. Similarly, a gap 127 is provided between the base 36 and the insulating member 125. These gaps allow for some displacement of the dielectric material within the cavity 31 to be displaced within the interconnection assembly 24, as well as between neighboring interconnection assemblies. In this regard, when one interconnection assembly is being actuated, the actuator therein is moved from the first position 200 to the second position 202. As noted above, dielectric material bulges from the receptacles 87 on the front of the housing and test ports 26 on top of the housing. Also, a portion of dielectric material will be displaced from the interconnection assembly 24 being actuated to the neighboring interconnection assembly. The dielectric material will tend to bulge through the lower space or gap 127. As such, the neighboring interconnection assemblies are not isolated or separated from each other and allow for degree of movement of the dielectric material between the interconnection assemblies. It is important to note that when the terminal block of the present invention is assembled, gel in the uncured state is allowed to flow throughout the entire cavity as it is dispensed into the cavity. It is important to note that when the gel cures, the gel mass within the cavity is a consistent mass and not specifically isolated into small pieces of gel as in the prior art. As such, there is some degree of movement and effect on the gel mass as a whole by actuation of each interconnection assembly. Retention of the interconnection assembly in the cured gel mass in an unstressed state tends to help maintain the gel mass within the housing and prevent loss of gel from any of the interconnecting assemblies.

The structures of the present invention also promote the thorough distribution of a "grease-like" dielectric material. The "grease-like" dielectric material is more viscous than the gel material and tends to flow throughout the housing. While actuation of the actuator from the first position 200 to the second position 202 will tend to displace grease outwardly through the receptacle 87 and test port 26, the grease will also flow around the frame-like actuator 32 and into neighboring interconnection assemblies 24. In this regard, the present invention helps to retain and maintain a consistent volume of grease-like dielectric material within the cavity 31. Additionally, because the cavity is a single generally continuous volume which is generally not separated into individual chambers, the grease can flow through the gap 127 between the neighboring interconnection assemblies.

In both situations, using a "grease-like" dielectric material or using a "gel-like" dielectric material, the dielectric material is retained within the cavity 31. The gel is displaceable relative to and the grease is flowable around and contact the exposed end of the conductor retained in the post 58 to seal the conductor from detrimental environmental effects. The dielectric material is maintained in thorough and intimate contact with the clips 30 and conductors positioned in the clips. As the actuator is moved downwardly and upwardly through the cavity 31, dielectric material is moved, displaced, or flows around the actuator.

The post 58 is provided with bores 132 opposite the forward portion 116. As such, as the conductor is moved downwardly through the slot 102 of the clip 30, with the forward portion 116 and post 58 supporting the conductor to assure proper engagement with the clip 30. Instead of providing a sealed end, the post 58 includes a stop rib 128. Either side of the stop rib 128 is open with a gap 130 being formed on either side thereof with respect to a bore 132 extending through the post 58.

The present invention also includes a resilient structure 300. The resilient structure is thin strip material which is retained over the receptacles 87. It should also be noted that the resilient structure 300 may also be placed over the test ports 26. An elastically expandable and contractable material is used for the resilient structure 300 to protect the dielectric material which bulges through the openings 26,87 from detrimental environmental effects.

As noted above, while it is desirable to allow the dielectric material to bulge from the openings 26,87, it may also be desirable to provide an added degree of environmental protection of the dielectric material. In one embodiment of the invention, the resilient structure 300 is not used because a dielectric material is not provided within the cavity 31. Even when a dielectric material is provided in the cavity 31, under some circumstances, it may not be necessary to provide the added degree of environmental protection provided by the resilient structure. However, if necessary, the resilient material can be applied to and retained on the housing so that when dielectric material bulges from the receptacles, for example, the resilient structure prevents the bulging dielectric material from being contacted by environmental effects such as dust, moisture, other particles or contact with a tradesperson using the terminal block. The elastic characteristics of the resilient structure help to return or replace the dielectric material which bulges out through the opening 26,87. An example of the material used for the resilient structure is 3M Corporation, 483 Tope having an acrylic adhesive.

With the interest in environmentally protecting the contact within the terminal block in mind, it should be noted that a cavity 136 formed on the underside of the base 36 is filled with a potting compound after the appropriate contacts between the incoming distribution cable 22 are made to the bottom prong portions 38 of the barrel clips 30. With reference to FIGS. 11, 12, 15 and 16, the prong structures 38 (as shown in FIGS. 8, 15 and 16) extend into the cavity 38. A wire is connected to the corresponding prong structure 38 to provide a conductive path from the barrel clip 30 to the wire connected thereto. The wires are retained in a strain relief device 140 also extending into the cavity 138. Once the appropriate lines from the distribution cable 22 are connected to the terminal block, the potting compound is placed in the cavity 38 and allowed to curve to seal the contacts made therein.

With the foregoing in mind, it should be noted that the present invention provides for terminating or connecting four conductors to the two barrel clips 30 of each interconnection assembly 24 from only one side of the housing 34. These improvements are important because prior art devices typically are designed as double sided blocks where the tip wire is connected to one side of the block and the ring wire is connected to the opposite side of the block. The present invention allows the tip and ring wires to be connected to the same side of block thereby improving installation efficiencies. Also, the ability to connect four wires allows multiple tip and ring connections without the addition of a separate half tap connector system.

Further still, the ability to connect four wires on one side of the terminal block allows for interconnection of wires as well as the connection of additional devices such as protection devices thereto. For example, a protection device may be connected to the bottom two receiving ports with the tip and ring wires connected to the upper two receiving ports 108. The use of a split barrel clip 30 as shown in the drawings is important in this regard because the independent first and second spring portions 62,64 accommodate a variety of different wire sizes. In other words, an 18 gage wire may be used for the tip and ring connections on the upper two ports whereas a 20 gage wire may be used for the protection module on the lower two ports.

As an additional consideration, the ability to terminate four wires simultaneously allows for the ability to cross-connect. Cross-connection is useful when a distribution wire is directly connected to the terminal block through the barrel clip 30 and the service line is also connected to the terminal block. This is an application in which there is no connection to the lower prongs 38 as described above. In other words, in the cross-connect application, the tip and ring wires are connected directly to the barrel clip 30. For example, the distribution tip and ring wires are connected through the upper receptacles 87 while the service tip and ring wires are connected to the lower receptacles 87. All four wires are retained in the corresponding receiving ports 108 and bores 132 in the actuator 32 which then can be downwardly displaced to cause simultaneous interconnection of the tip and ring wire with the spring portions 62,64 of the barrel clips 30. The present invention also allows easy disconnection or modification of connection as necessary.

The present invention also eliminates the need for special tools and complicated connection procedures. Some prior art devices employ specialized tools in order to downwardly displace a wire into a corresponding insulation displacement connector. Such a tool may be necessary in the prior art of devices to support the wires as they are coupled to the IDC because the device does not provide an actuator.

As described hereinabove, the present invention employs a driver 28 which has a driver head 48. The driver head is formed with a hex external design to accommodate an hexagonal drive tool. The hex design is sized and dimensioned relative to the driver well 50 to accommodate the dimensions of a drive tool. Further, a standard flat blade screwdriver recess is provided to accommodate a flat bladed screwdriver. The ability to use standard tools is made possible by the novel structure of the actuator 32.

The actuator 32 employs the post 58 extending through the passage 60 in the barrel clip 30. A conductor extends through the receiving port 108 on the forward structure 116 and through the bore 132 in the post 58. The conductor is then supported on both sides of the slot 102 of the barrel clip 30. As an additional benefit of the structure of the present invention, the actuator also facilitates easy removal of the conductors from the clip 30. Because the conductor extends through the receiving port 108 and the bore 132 and the structures surround the outside of the conductor, the conductor will also be lifted out of engagement with the clip 30 when the actuator is displaced upwardly in the sections 110.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A terminal block for connecting a conductive member to a conductive contact, said terminal block comprising:

a base;

a housing retained on said base, a cavity being defined between said base and said housing, said housing having at least one opening communicating with said cavity;

a conductive contact at least partially retained in said cavity;

an actuator moveably retained in said housing, said actuator defining at least one receiving port for receiving a conductive member, said actuator being moveable upwardly from a fist position generally adjacent said base to a second position in said cavity generally adjacent an upper portion of said housing, said first position being in close proximity to said conductive contact, said actuator being moveable from said first position to said second position to generally align said receiving port with at least a portion of said opening for receiving a conductive member through said opening into said receiving port, said actuator being moveable downwardly from said second position to said first position for engaging said conductive member with said conductive connector;

an actuator driver coupled to said actuator for moving said actuator in said housing, said actuator driver being coupled to said actuator for providing a mechanical advantage in moving said actuator between said first and second positions; and an elastically displaceable dielectric material cured in said cavity encapsulating said conductive contact and actuator in said first position, movement of said actuator from said fist position to said second position causing at least a portion of said elastically displaceable dielectric material to be displaced out of said cavity of said housing, movement of said actuator from said second position to said first position causing said displaced portion of said elastically displaceable dielectric material to be returned to said cavity.

2. A terminal block according to claim 1, further comprising a resilient structure retained over at least said opening, said resilient structure being elastically expanded and contracting upon displacement and replacement, respectively, of said elastically displaceable dielectric material through said opening, said resilient structure protecting said elastically displaceable dielectric material from detrimental environmental effects.

3. A terminal block according to claim 1, said elastically displaceable dielectric material comprising a non-conductive gel.

4. A terminal block according to claim 1, wherein said actuator driver includes a threaded portion threadedly engaged with a corresponding treaded portion of said actuator, said actuator driver being rotated for producing generally axial displacement of said actuator between said first and second positions.

5. A terminal block according to claim 1, further comprising a head portion on said actuator driver being accessible externally of said housing for activating said actuator externally of said housing.

6. A terminal block according to claim 1, said actuator comprising a frame, said elastically displaceable dielectric material generally displaceable around said frame when moved between said first and second positions.

7. A terminal block according to claim 1 in which said base provides a foundation for supporting said conductive contact in said housing.

8. A terminal block according to claim 1, said conductive contact having a test point thereon, said housing defining a test port spaced apart from said opening, said test port providing access to said test point spaced apart from said opening.

9. A terminal block according to claim 10, further including a guide structure thereon for directing a testing member extending into said test port into engagement with said test point.

10. A terminal block according to claim 1, further comprising at least two openings associated with said actuator.

11. A terminal block according to claim 10, wherein said at least two openings associated with said actuator are D-shaped for accepting an F-drop wire therethrough.

12. A terminal block according to claim 1, further comprising an actuator guide channel positioned in said housing, said actuator guide channel receiving a portion of said actuator therein for guiding movement of said actuator within said housing.

13. A terminal block according to claim 1 in which at least a portion of the conductive contact extends through said base, and in which a potting compound contacts at least a part of said portion of the conductive contact extending through said base.

14. A terminal block according to claim 1, said housing having at least two openings on the same side of said housing for providing that both a tip and ring connection can be made into the same side of said housing.

15. A terminal block for engaging conductive members received by the terminal block with conductive contacts in the terminal block, said terminal block comprising:

a housing having a cavity formed therein, said housing having a plurality of openings for receiving said conductive members into said housing;

interconnection assemblies retained in said housing, said interconnection assemblies including: an actuator aligned with at least one of said openings in said housing and movable within said housing for securably engaging one or more conductive members with a corresponding one of said conductive contacts in said housing and an actuator driver for activating said actuator;

at least one insulating portion disposed in said housing between neighboring interconnection assemblies, said insulating portions dividing said cavity into a plurality of interconnected sections, each interconnected section of said plurality of interconnected sections communicating with neighboring interconnected sections; and an elastically displaceable dielectric material cured in said cavity within and between each of said plurality of interconnected sections encapsulating at least a portion of said interconnection assemblies in said cavity.

16. A terminal block according to claim 15, each of said insulating portions defining a divider defining a passageway in said cavity for permitting displacement of said elastically displaceable dielectric material between said interconnected sections within said cavity in said housing.

17. A method as set forth in claim 16, further comprising the steps of:

providing a resilient structure for protecting said elastically displaceable dielectric material from detrimental environmental effects;

attaching said resilient structure to said housing over at least said opening;

expanding said resilient structure away from said opening upon displacement of said elastically displaceable dielectric material through said opening; and contracting said resilient structure towards said opening upon replacement of said elastically displaceable dielectric material to said cavity through said opening.

18. A terminal block according to claim 15, said elastically displaceable dielectric material comprising non-conducting gel.

19. A terminal block according to claim 15, said actuator comprising a frame-like structure, said elastically displaceable dielectric material displaceable relative to said frame-like structure when said actuator driver is activated to move said actuator.

20. A terminal block according to claim 15, said conductive contact including a barrel shaped insulation displacement connector portion, said connector portion including a pair of arms defining a slot through which said conductive member is moved, said actuator including a stabilizing member extend through a passage defined by said conductive contact.

21. A method of engaging a conductive member with a conductive contact in a terminal block, said terminal block including a base, a housing retained on the base, a cavity being defined between said base and said housing, said housing having at least one opening communicating with said cavity, said conductive contact at least partially retained in said cavity, an actuator moveably retained in said housing, said actuator defining at least one receiving port, and an actuator driver coupled to said actuator for moving said actuator in said housing, said method comprising the steps of:

depositing an uncured elastically displaceable dielectric material in said cavity so that said actuator and said conductive contact retained in said housing are immersed in said elastically displaceable dielectric material;

curing said elastically displaceable dielectric material in said cavity so that said conductive contact and said actuator are encapsulated with elastically displaceable dielectric material, said curing being carried out with said actuator in a first position so that said actuator is encapsulated in said first position, said first position being generally adjacent said base;

moving said actuator from said first position to a second position in said cavity to generally align said receiving port with said opening, said second position being generally adjacent an upper portion of said cavity, movement of said actuator from said first position to said second position causing at least a portion of said elastically displaceable dielectric material to be displaced out of said cavity of said housing;

inserting said conductive member through said opening and into said receiving port;

moving said actuator from said second position to said first position for engaging said conductive member with said conductive contact, movement of said actuator from said second position to said first position causing said displaced portion of said elastically displaceable dielectric material to be returned to said cavity.

22. A method of assembling a terminal block, said method comprising the steps of:

providing a housing having openings therein, a base having at least one conductive contact thereon, and an actuator, covering said openings on an outside of said housing;

placing said actuator in close proximity to said conductive contact;

placing said conductive contact in said housing;

depositing an uncured dielectric gel in said housing so that said conductive contact and said actuator retained in said housing are immersed in said uncured dielectric gel; and curing said dielectric gel so that said conductive contact and said actuator are encapsulated with dielectric gel, said curing being carried out with said actuator positioned in close proximity to said conductive contact so that said actuator is encapsulated with dielectric gel in close proximity to said conductive contact.

23. A method as set forth in claim 22, further comprising the steps of:

providing an actuator driver for producing a mechanical advantage in moving said actuator in said housing;

assembling said actuator driver to said actuator with said actuator being set in a first position;

positioning said assembled actuator driver and actuator in said housing; and positioning said conductive contact in said housing to position said actuator in close proximity thereto.

24. A method as set forth in claim 22, further comprising the steps of:

providing a sheet of resilient material;

attaching said sheet of resilient material over at least said opening before depositing said uncured dielectric gel into said housing to prevent said uncured dielectric gel from leaking from said housing prior to curing.

25. A method of providing environmental protection for a conductive connection of a conductive member and a conductive structure in a terminal block, said terminal block including a base, a housing retained on said base, a cavity being defined between said base and said housing, said housing defining at least one opening for communicating with said cavity, a conductive contact at least partially retained in said cavity, an actuator moveably retained in said housing, an actuator driver coupled to said actuator for moving said actuator in said housing an elastically displaceable dielectric material cured in said cavity encapsulating said conductive contact and actuator in a first position, said first position being generally adjacent said base, said method comprising the steps of:

operating said actuator drive to move said actuator upwardly from said first position to a second position in said cavity to receive said conductive member therein; said second position being generally adjacent an upper portion of said cavity, movement of said actuator from said first position to said second position causing at least a portion of said elastically displaceable dielectric material to be displaced out of said cavity of said housing;

inserting said conductive member into said actuator; and operating said actuator driver to move said actuator downwardly from said second position to said first position for engaging said conductive member with said conductive contact; movement of said actuator from said second position to said first position causing said displaced portion of said elastically displaceable dielectric material to be returned to said cavity.

26. A method as set forth in claim 25, further comprising the steps of:

providing a sheet of resilient material; and retaining said sheet of resilient material over at least said opening;

said sheet of resilient material being expanded away from said opening when said elastically displaceable dielectric material is displaced through said opening, said sheet of resilient material contracting towards said opening when said displaced elastically displaceable dielectric material returns to said cavity through said opening.

* * * * *